US008291969B2

(12) United States Patent
Swor et al.

(10) Patent No.: US 8,291,969 B2
(45) **Date of Patent: *Oct. 23, 2012**

(54) CONSUMABLE DOWNHOLE TOOLS

(75) Inventors: Loren C. Swor, Duncan, OK (US); Phillip M. Starr, Duncan, OK (US); Don R. Smith, Wilson, OK (US); Brian Keith Wilkinson, Duncan, OK (US); Michael C. Robertson, Arlington, TX (US)

(73) Assignees: Halliburton Energy Services Inc., Duncan, OK (US); MCR Oil Tools, LLC, Burleson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/218,198

(22) Filed: Aug. 25, 2011
(Under 37 CFR 1.47)

(65) Prior Publication Data

US 2011/0303407 A1 Dec. 15, 2011

Related U.S. Application Data

(63) Continuation of application No. 12/639,567, filed on Dec. 16, 2009, now abandoned, which is a continuation of application No. 11/423,076, filed on Jun. 8, 2006, now abandoned.

(51) Int. Cl.
*E21B 36/00* (2006.01)

(52) U.S. Cl. ..... 166/58; 166/59; 166/63; 166/118

(58) Field of Classification Search ..... 166/58, 166/59, 63, 118, 243, 376, 377
See application file for complete search history.

(56) References Cited

U.S. PATENT DOCUMENTS

| | | | |
|---|---|---|---|
| 2,152,306 | A | 3/1939 | Grebe et al. |
| 2,191,783 | A | 2/1940 | Wells |
| 2,238,671 | A | 4/1941 | Woodhouse |
| 2,261,292 | A | 11/1941 | Salnikov |
| 2,436,036 | A | 2/1948 | Defenbaugh |
| 2,571,636 | A | 10/1951 | Watkins |
| 2,703,316 | A | 3/1955 | Schneider |
| 2,867,170 | A | 1/1959 | Kibby |
| 2,898,999 | A | 8/1959 | Carpenter |
| 2,935,020 | A | 5/1960 | Howard et al. |
| 3,053,182 | A | 9/1962 | Christopher |

(Continued)

FOREIGN PATENT DOCUMENTS

EP 0681087 A2 11/1995

(Continued)

OTHER PUBLICATIONS

Office Action dated Oct. 5, 2011 (8 pages), U.S. Appl. No. 12/860,471, filed Aug. 20, 2010.

(Continued)

*Primary Examiner* — Nicole Coy
(74) *Attorney, Agent, or Firm* — John W. Wustenberg; Conley Rose, P.C.

(57) ABSTRACT

A downhole tool having a body or structural component comprises a material that is at least partially consumed when exposed to heat and a source of oxygen. The material may comprise a metal, such as magnesium, which is converted to magnesium oxide when exposed to heat and a source of oxygen. The downhole tool may further comprise a torch with a fuel load that produces the heat and source of oxygen when burned. The fuel load may comprise a flammable, non-explosive solid, such as thermite.

30 Claims, 4 Drawing Sheets

U.S. PATENT DOCUMENTS

| | | | |
|---|---|---|---|
| 3,087,549 | A | 4/1963 | Brunton |
| 3,099,318 | A | 7/1963 | Miller et al. |
| 3,173,484 | A | 3/1965 | Huitt et al. |
| 3,195,635 | A | 7/1965 | Fast |
| 3,205,947 | A | 9/1965 | Parker |
| 3,211,232 | A | 10/1965 | Grimmer |
| 3,302,719 | A | 2/1967 | Fischer |
| 3,364,995 | A | 1/1968 | Atkins et al. |
| 3,366,178 | A | 1/1968 | Malone et al. |
| 3,382,927 | A | 5/1968 | Davis, Jr. |
| 3,414,055 | A | 12/1968 | Vogt, Jr. |
| 3,455,390 | A | 7/1969 | Gallus |
| 3,768,563 | A | 10/1973 | Blount |
| 3,784,585 | A | 1/1974 | Schmitt et al. |
| 3,828,854 | A | 8/1974 | Templeton et al. |
| 3,868,998 | A | 3/1975 | Lybarger et al. |
| 3,912,692 | A | 10/1975 | Casey et al. |
| 3,954,438 | A | 5/1976 | Hunter et al. |
| 3,954,788 | A | 5/1976 | Hunter et al. |
| 3,960,736 | A | 6/1976 | Free et al. |
| 3,968,840 | A | 7/1976 | Tate |
| 3,997,277 | A | 12/1976 | Swisher, Jr. et al. |
| 3,998,744 | A | 12/1976 | Arnold et al. |
| 4,023,494 | A | 5/1977 | Barton et al. |
| 4,068,718 | A | 1/1978 | Cooke, Jr. et al. |
| 4,089,035 | A | 5/1978 | Smith |
| 4,099,464 | A | 7/1978 | Cross et al. |
| 4,167,521 | A | 9/1979 | Fowler et al. |
| 4,169,798 | A | 10/1979 | DeMartino |
| 4,178,852 | A | 12/1979 | Smith et al. |
| 4,248,299 | A | 2/1981 | Roeder |
| D327,105 | S | 6/1992 | Smith, Jr. |
| D340,412 | S | 10/1993 | Smith |
| D381,024 | S | 7/1997 | Hinzmann et al. |
| D387,865 | S | 12/1997 | Peckham et al. |
| D412,062 | S | 7/1999 | Potter et al. |
| D473,517 | S | 4/2003 | Overthun et al. |
| D481,226 | S | 10/2003 | Overthun et al. |
| D485,096 | S | 1/2004 | Overthun et al. |
| 6,854,521 | B2 | 2/2005 | Echols et al. |
| D520,355 | S | 5/2006 | Overthun et al. |
| 7,798,236 | B2 | 9/2010 | McKeachnie et al. |
| 2012/0031626 | A1 | 2/2012 | Clayton et al. |
| 2012/0048572 | A1 | 3/2012 | Swor et al. |
| 2012/0055666 | A1 | 3/2012 | Swor et al. |

FOREIGN PATENT DOCUMENTS

| | | | |
|---|---|---|---|
| EP | 1132571 | A1 | 9/2001 |
| GB | 2410964 | A | 8/2005 |
| WO | 0057022 | A1 | 9/2000 |
| WO | 0102698 | A1 | 1/2001 |
| WO | 0177484 | A1 | 10/2001 |
| WO | 2004007905 | A1 | 1/2004 |
| WO | 2004037946 | A1 | 5/2004 |
| WO | 2004038176 | A1 | 5/2004 |

OTHER PUBLICATIONS

Advisory Action dated Sep. 12, 2011 (3 pages), U.S. Appl. No. 12/860,471, filed Aug. 20, 2010.

Advisory Action dated Sep. 12, 2011 (3 pages), U.S. Appl. No. 12/650,939, filed Dec. 31, 2009.

Office Action dated Dec. 7, 2011 (78 pages), U.S. Appl. No. 13/277,016, filed Oct. 19, 2011.

Office Action dated Dec. 19, 2011 (74 pages), U.S. Appl. No. 13/293,557, filed Nov. 10, 2011.

Office Action dated Feb. 2, 2012 (83 pages), U.S. Appl. No. 13/293,502, filed Nov. 10, 2011.

Office Action dated May 16, 2012 (18 pages), U.S. Appl. No. 13/277,016, filed Oct. 19, 2011.

Ahmad, M., et al., "Ortho Ester Hydrolysis: Direct Evidence for a Three-Stage Reaction Mechanism," XP-002322843, May 9, 1979, 1 page.

Becker, Thomas E., et al., Drill-in fluid filter-cake behavior during the gravel-packing of horizontal intervals—a laboratory simulation, SPE 50715, 1999, pp. 1-7, Society of Petroleum Engineers, Inc.

Brady, M. E., et al., "Filtercake cleanup in open-hole gravel-packed completions: a necessity or a myth?" SPE 63232, 2000, pp. 1-12, Society of Petroleum Engineers Inc.

Cantu, Lisa A., et al., "Laboratory and field evaluation of a combined fluid-loss-control additive and gel breaker for fracturing fluids," SPE Production Engineering, Aug. 1990, pp. 253-260, Society of Petroleum Engineers.

Chiang, Y., et al., "Hydrolysis of ortho esters: further investigation of the factors which control the rate-determining step," XP-002322842, Nov. 16, 1983, 1 page.

Dechy-Cabaret, Odile, et al., "Controlled ring-opening polymerization of lactide and glycolide," American Chemical Society, Apr. 26, 2004, 30 pages.

Demo Lab: The Thermite Reaction, "The general chemistry demo lab," http://www.ilpi.com/genchem/demo/thermite/index.html, Jun. 7, 2006, pp. 1-5.

Dickinson, W., et al., "A second-generation horizontal drilling system," IADC/SPE 14804, 1986, pp. 673-678 plus 4 pages of drawings, IADC/SPE 1986 Drilling Conference.

Dickinson, W. et al., "Gravel packing of horizontal wells," SPE 16931, 1987, pp. 519-528, Society of Petroleum Engineers.

Economides, Michael J., "Petroleum well construction," 1998, pp. 8-10, 405-409, 533-534, 537-542, 1 cover page, and 1 publishing page, John Wiley & Sons Ltd, England.

Fibox Enclosing Innovations, "Chemical resistance—polycarbonate," www.fiboxusa.com, Jul. 25, 2007, pp. 1-5, Fibox Enclosures.

Foreign communication from a related counterpart application—International Search Report, PCT/GB2005/000166, Mar. 17, 2005, 2 pages.

Foreign communication from a related counterpart application—International Search Report, PCT/GB2004/005309, Apr. 13, 2005, 4 pages.

Foreign communicaiton from a related counterpart application—International Search Report and Written Opinion, PCT/GB2005/000995, Jun. 7, 2005, 13 pages.

Foreign comunication from a related counterpart application—International Preliminary Report on Patentability, PCT/GB2004/005309, Jul. 10, 2006, 7 pages.

Foreign communication from a related counterpart application—International Search Report and Written Opinion, PCT/GB2007/002111, Sep. 3, 2007, 11 pages.

Foreign communication from a related counterpart application—Invitation to Pay Additional Fees, PCT/GB2007/002754, Oct. 2, 2007, 5 pages.

Foreign communication from a related counterpart application—International Search Report and Written Opinion, PCT/GB2007/002754, Dec. 10, 2007, 16 pages.

Foreign communication from a related counterpart application—Invitation to Pay Additional Fees, PCT/GB2008/000561, Jun. 3, 2008, 4 pages.

Foreign communication from a related counterpart application—EPO Examination Report for European Application No. 07 766 317.7, Oct. 1, 2009, 2 pages.

Foreign communication from a related counterpart application—EPO Examination Report for European Application No. 07 766 317.7, Mar. 10, 2010, 4 pages.

Halliburton brochure entitled "Sand control applications," pp. 2-1 to 2-6, Halliburton.

Heller, J., et al., "Poly(ortho esters)—their development and some recent applications," European Journal of Pharmaceutics and Biopharmaceutics, 2000, pp. 121-128, vol. 50, Elsevier Science B.V.

Heller, J., et al., "Release of norethindrone from poly(ortho esters)," Mid-Aug. 1981, pp. 727-731, vol. 21, No. 11, Polymer Engineering and Science.

Heller, Jorge, et al., "Poly(ortho esters) for the pulsed and continuous delivery of peptides and proteins," Controlled Release and Biomedical Polymers Department, SRI International, pp. 39-56.

Heller, Jorge, et al., "Poly(ortho esters)—from concept to reality," Biomacromolecules, Sep./Oct. 2004, pp. 1625-1632, vol. 5, No. 5, American Chemical Society.

Heller, Jorge, et al., "Poly(ortho esters): synthesis, characterization, properties and uses," Advanced Drug Delivery Reviews, 2002, pp. 1015-1039, vol. 54, Elsevier Science B.V.

Lafontaine, Jackie, et al., "New concentric annular packing system limits bridging in horizontal gravel packs," SPE 56778, 1999, pp. 1-11, Society of Petroleum Engineers, Inc.
Ng, S.Y., et al., "Development of a poly(ortho ester) prototype with a latent acid in the polymer backbone for 5-flourouracil delivery," Journal of Controlled Release, 2000, pp. 367-374, vol. 65, Elsevier Science B.V.
Ng, S.Y., et al., "Synthesis and erosion studies of self-catalyzed poly(ortho ester)s," Macromolecules, 1997, pp. 770-772, vol. 30, No. 4, American Chemical Society.
Office Action dated Jan. 31, 2008 (7 pages), U.S. Appl. No. 11/423,076, filed Jun. 8, 2006.
Office Action dated Jan. 31, 2008 (12 pages), U.S. Appl. No. 11/423,081, filed Jun. 8, 2006.
Office Action (Final) dated Aug. 12, 2008 (11 pages), U.S. Appl. No. 11/423,081, filed Jun. 8, 2006.
Office Action (Final) dated Aug. 12, 2008 (12 pages), U.S. Appl. No. 11/423,076, filed Jun. 8, 2006.
Office Action dated Dec. 15, 2008 (44 pages), U.S. Appl. No. 11/677,755, filed Feb. 22, 2007.
Office Action dated Mar. 16, 2009 (21 pages), U.S. Appl. No. 11/423,076, filed Jun. 8, 2006.
Office Action dated Mar. 17, 2009 (24 pages), U.S. Appl. No. 11/423,081, filed Jun. 8, 2006.
Office Action dated Mar. 18, 2009 (9 pages), U.S. Appl. No. 12/120,169, filed May 13, 2008.
Office Action dated Jul. 27, 2009 (11 pages), U.S. Appl. No. 11/423,076, filed Jun. 8, 2006.
Office Action (Final) dated Aug. 6, 2009 (13 pages), U.S. Appl. No. 11/677,755, filed Feb. 22, 2007.
Office Action (Final) dated Aug. 12, 2009 (57 pages) U.S. Appl. No. 12/120,169, filed May 13, 2008.
Office Action (Final) dated Aug. 14, 2009 (14 pages), U.S. Appl. No. 11/423,081, filed Jun. 8, 2006.
Office Action dated May 10, 2010 (65 pages), U.S. Appl. No. 12/548,169, filed Aug. 26, 2009.
Office Action dated Aug. 12, 2010 (58 pages), U.S. Appl. No. 12/639,567, filed Dec. 16, 2009.
Office Action dated May 11, 2010 (9 pages), U.S. Appl. No. 12/649,802, filed Dec. 30, 2009.
PoroFlex™ Expandable Screen Completion Systems, Discussion and Development Status, 40 pages.
Rothen-Weinhold, A., et al., "Release of BSA from poly(ortho ester) extruded thin strands," Journal of Controlled Release, 2001, pp. 31-37, vol. 71, Elsevier Science B.V.
Rozner, A. G., et al., "Pyronol torch—a non-explosive underwater cutting tool," Offshore Technology Conference, Paper No. OTC 2705, 1976, pp. 1015-1020 plus 2 pages of figures, American Institute of Mining, Metallurgical, and Petroleum Engineers, Inc.
Schlumberger brochure entitled "STIMPAC service brochure," 2000, 8 pages, Schlumberger Limited.
Schwach-Abdellaoui, K., et al., "Control of molecular weight for auto-catalyzed poly(ortho ester) obtained by polycondensation reaction," International Journal of Polymer Anal. Charact., 2002, pp. 145-161, vol. 7, Taylor & Francis.

110
112
114
105
120
127
118
100
125
F

CONSUMABLE DOWNHOLE TOOLS

CROSS-REFERENCE TO RELATED APPLICATIONS

This application is a continuation of U.S. patent application Ser. No. 12/639,567, filed Dec. 16, 2009 by Loren Craig Swor, et al., now published as U.S. 2010/0089566 A1, which is a continuation of U.S. patent application Ser. No. 11/423,076, filed Jun. 8, 2006 by Loren Craig Swor, et al., published as U.S. 2007/0284097 A1, now abandoned, and entitled "Consumable Downhole Tools," each of which applications is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to consumable downhole tools and methods of removing such tools from well bores. More particularly, the present invention relates to downhole tools comprising materials that are burned and/or consumed when exposed to heat and an oxygen source and methods and systems for consuming such downhole tools in situ.

BACKGROUND

A wide variety of downhole tools may be used within a well bore in connection with producing hydrocarbons or reworking a well that extends into a hydrocarbon formation. Downhole tools such as frac plugs, bridge plugs, and packers, for example, may be used to seal a component against casing along the well bore wall or to isolate one pressure zone of the formation from another. Such downhole tools are well known in the art.

After the production or reworking operation is complete, these downhole tools must be removed from the well bore. Tool removal has conventionally been accomplished by complex retrieval operations, or by milling or drilling the tool out of the well bore mechanically. Thus, downhole tools are either retrievable or disposable. Disposable downhole tools have traditionally been formed of drillable metal materials such as cast iron, brass and aluminum. To reduce the milling or drilling time, the next generation of downhole tools comprises composites and other non-metallic materials, such as engineering grade plastics. Nevertheless, milling and drilling continues to be a time consuming and expensive operation. To eliminate the need for milling and drilling, other methods of removing disposable downhole tools have been developed, such as using explosives downhole to fragment the tool, and allowing the debris to fall down into the bottom of the well bore. This method, however, sometimes yields inconsistent results. Therefore, a need exists for disposable downhole tools that are reliably removable without being milled or drilled out, and for methods of removing such disposable downhole tools without tripping a significant quantity of equipment into the well bore.

SUMMARY OF THE INVENTION

Disclosed herein is a downhole tool having a body or structural component comprising a material that is at least partially consumed when exposed to heat and a source of oxygen. In an embodiment, the material comprises a metal, and the metal may comprise magnesium, such that the magnesium metal is converted to magnesium oxide when exposed to heat and a source of oxygen. The downhole tool may further comprise an enclosure for storing an accelerant. In various embodiments, the downhole tool is a frac plug, a bridge plug, or a packer.

The downhole tool may further comprise a torch with a fuel load that produces the heat and source of oxygen when burned. In various embodiments, the fuel load comprises a flammable, non-explosive solid, or the fuel load comprises thermite. The torch may further comprise a torch body with a plurality of nozzles distributed along its length, and the nozzles may distribute molten plasma produced when the fuel load is burned. In an embodiment, the torch further comprises a firing mechanism with heat source to ignite the fuel load, and the firing mechanism may further comprise a device to activate the heat source. In an embodiment, the firing mechanism is an electronic igniter. The device that activates the heat source may comprise an electronic timer, a mechanical timer, a spring-wound timer, a volume timer, or a measured flow timer, and the timer may be programmable to activate the heat source when pre-defined conditions are met. The pre-defined conditions comprise elapsed time, temperature, pressure, volume, or any combination thereof. In another embodiment, the device that activates the heat source comprises a pressure-actuated firing head.

NOTATION AND NOMENCLATURE

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", "upwardly" or "upstream" meaning toward the surface of the well and with "down", "lower", "downwardly" or "downstream" meaning toward the lower end of the well, regardless of the well bore orientation. Reference to a body or a structural component refers to components that provide rigidity, load bearing ability and/or structural integrity to a device or tool.

DETAILED DESCRIPTION

Figure 1:
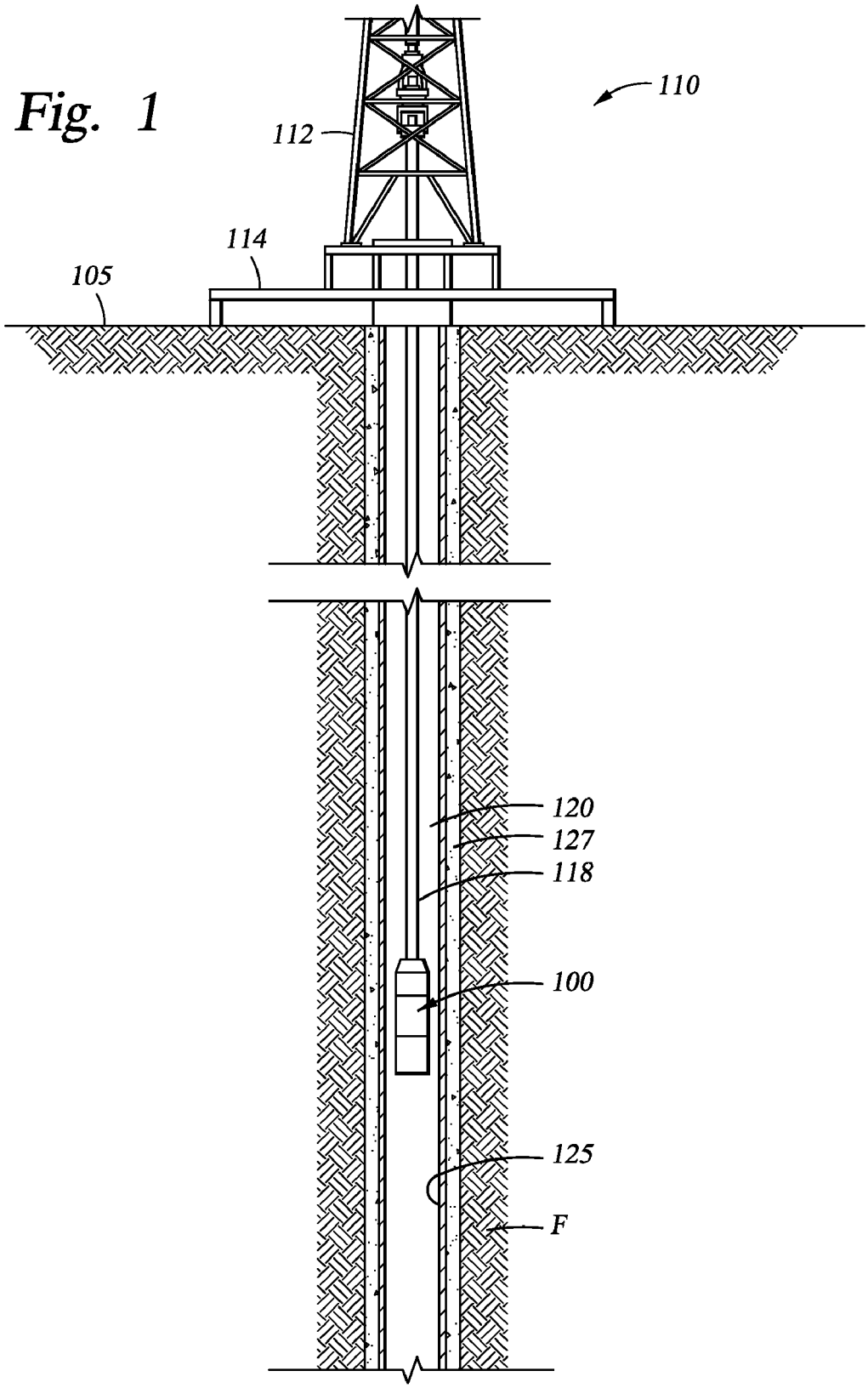
FIG. 1 is a schematic, cross-sectional view of an exemplary operating environment depicting a consumable downhole tool being lowered into a well bore extending into a subterranean hydrocarbon formation.

FIG. 1 schematically depicts an exemplary operating environment for a consumable downhole tool 100. As depicted, a drilling rig 110 is positioned on the earth's surface 105 and extends over and around a well bore 120 that penetrates a subterranean formation F for the purpose of recovering hydrocarbons. At least the upper portion of the well bore 120 may be lined with casing 125 that is cemented 127 into position against the formation F in a conventional manner. The drilling rig 110 includes a derrick 112 with a rig floor 114 through which a work string 118, such as a cable, wireline, E-line, Z-line, jointed pipe, or coiled tubing, for example, extends downwardly from the drilling rig 110 into the well bore 120. The work string 118 suspends a representative consumable downhole tool 100, which may comprise a frac plug, a bridge plug, a packer, or another type of well bore zonal isolation device, for example, as it is being lowered to a predetermined depth within the well bore 120 to perform a specific operation. The drilling rig 110 is conventional and therefore includes a motor driven winch and other associated equipment for extending the work string 118 into the well bore 120 to position the consumable downhole tool 100 at the desired depth.

While the exemplary operating environment depicted in FIG. 1 refers to a stationary drilling rig 110 for lowering and setting the consumable downhole tool 100 within a land-based well bore 120, one of ordinary skill in the art will readily appreciate that mobile workover rigs, well servicing units, such as slick lines and e-lines, and the like, could also be used to lower the tool 100 into the well bore 120. It should be understood that the consumable downhole tool 100 may also be used in other operational environments, such as within an offshore well bore.

Figure 2:
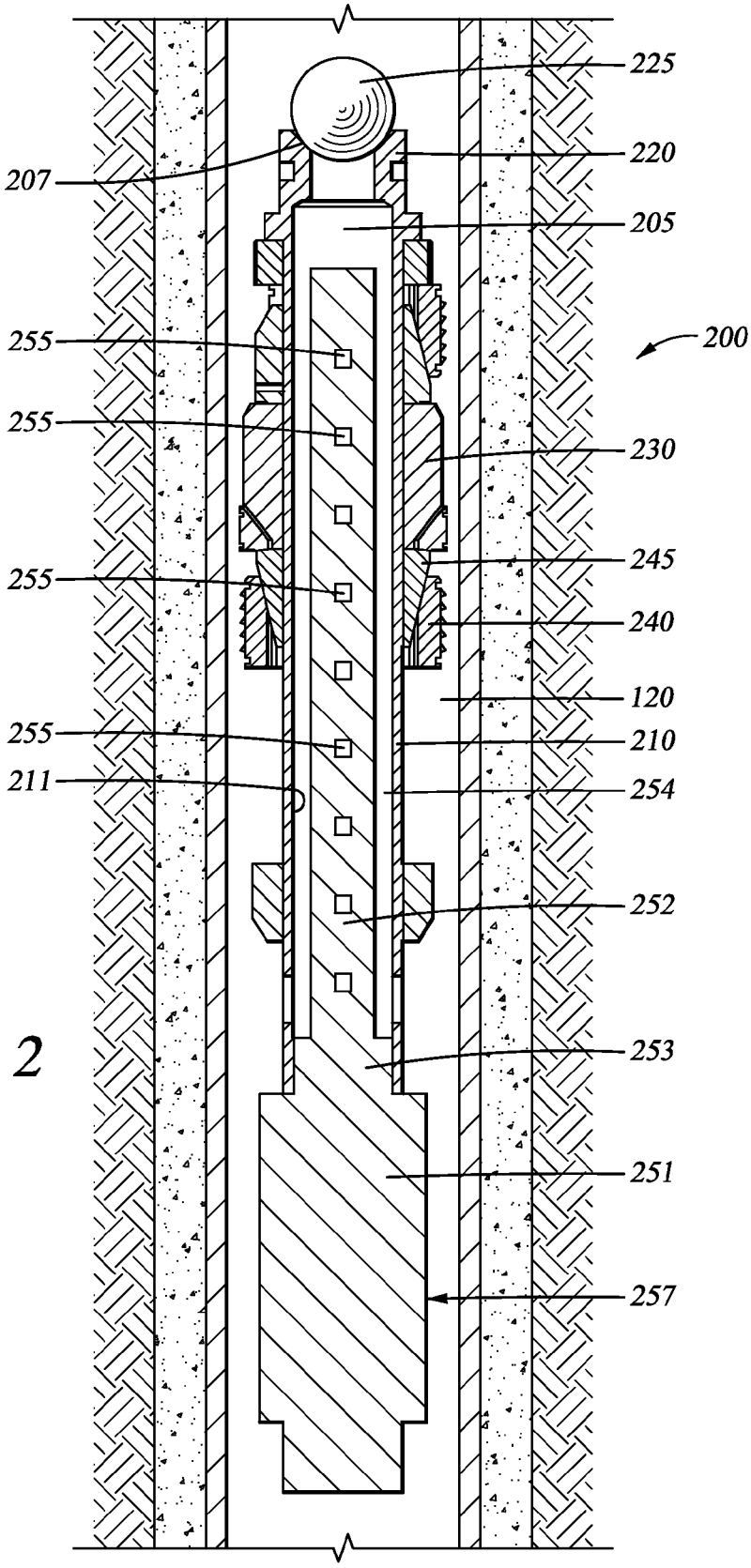
FIG. 2 is an enlarged cross-sectional side view of one embodiment of a consumable downhole tool comprising a frac plug being lowered into a well bore.

The consumable downhole tool 100 may take a variety of different forms. In an embodiment, the tool 100 comprises a plug that is used in a well stimulation/fracturing operation, commonly known as a "frac plug." FIG. 2 depicts an exemplary consumable frac plug, generally designated as 200, as it is being lowered into a well bore 120 on a work string 118 (not shown). The frac plug 200 comprises an elongated tubular body member 210 with an axial flowbore 205 extending therethrough. A ball 225 acts as a one-way check valve. The ball 225, when seated on an upper surface 207 of the flowbore 205, acts to seal off the flowbore 205 and prevent flow downwardly therethrough, but permits flow upwardly through the flowbore 205. In some embodiments, an optional cage, although not included in FIG. 2, may be formed at the upper end of the tubular body member 210 to retain ball 225. A packer element assembly 230 extends around the tubular body member 210. One or more slips 240 are mounted around the body member 210, above and below the packer assembly 230. The slips 240 are guided by mechanical slip bodies 245. A cylindrical torch 257 is shown inserted into the axial flowbore 205 at the lower end of the body member 210 in the frac plug 200. The torch 257 comprises a fuel load 251, a firing mechanism 253, and a torch body 252 with a plurality of nozzles 255 distributed along the length of the torch body 252. The nozzles 255 are angled to direct flow exiting the nozzles 255 towards the inner surface 211 of the tubular body member 210. The firing mechanism 253 is attached near the base of the torch body 252. An annulus 254 is provided between the torch body 252 and the inner surface 211 of the tubular body member 210, and the annulus 254 is enclosed by the ball 225 above and by the fuel load 251 below.

At least some of the components comprising the frac plug 200 may be formed from consumable materials, such as metals, for example, that burn away and/or lose structural integrity when exposed to heat and an oxygen source. Such consumable components may be formed of any consumable material that is suitable for service in a downhole environment and that provides adequate strength to enable proper operation of the frac plug 200. By way of example only, one such material is magnesium metal. In operation, these components may be exposed to heat and oxygen via flow exiting the nozzles 255 of the torch body 252. As such, consumable components nearest these nozzles 255 will burn first, and then the burning extends outwardly to other consumable components.

Any number or combination of frac plug 200 components may be made of consumable materials. In an embodiment, the load bearing components of the frac plug 200, including the tubular body member 210, the slips 240, the mechanical slip bodies 245, or a combination thereof, may comprise consumable material, such as magnesium metal. These load bearing components 210, 240, 245 hold the frac plug 200 in place during well stimulation/fracturing operations. If these components 210, 240, 245 are burned and/or consumed due to exposure to heat and oxygen, they will lose structural integrity and crumble under the weight of the remaining plug 200 components, or when subjected to other well bore forces, thereby causing the frac plug 200 to fall away into the well bore 120. In another embodiment, only the tubular body member 210 is made of consumable material, and consumption of that body member 210 sufficiently compromises the structural integrity of the frac plug 200 to cause it to fall away into the well bore 120 when the frac plug 200 is exposed to heat and oxygen.

The fuel load 251 of the torch 257 may be formed from materials that, when ignited and burned, produce heat and an oxygen source, which in turn may act as the catalysts for initiating burning of the consumable components of the frac plug 200. By way of example only, one material that produces heat and oxygen when burned is thermite, which comprises iron oxide, or rust ($Fe_2O_3$), and aluminum metal power (Al). When ignited and burned, thermite reacts to produce aluminum oxide ($Al_2O_3$) and liquid iron (Fe), which is a molten plasma-like substance. The chemical reaction is:

$$Fe_2O_3+2Al(s)\rightarrow Al_2O_3(s)+2Fe(1)$$

The nozzles 255 located along the torch body 252 are constructed of carbon and are therefore capable of withstanding the high temperatures of the molten plasma substance without melting. However, when the consumable components of the frac plug 200 are exposed to the molten plasma, the components formed of magnesium metal will react with the oxygen in the aluminum oxide ($Al_2O_3$), causing the magnesium metal to be consumed or converted into magnesium oxide (MgO), as illustrated by the chemical reaction below:

$$3Mg+Al_2O_3\rightarrow 3MgO+2Al$$

When the magnesium metal is converted to magnesium oxide, a slag is produced such that the component no longer has structural integrity and thus cannot carry load. Application of a slight load, such as a pressure fluctuation or pressure pulse, for example, may cause a component made of magnesium oxide slag to crumble. In an embodiment, such loads are applied to the well bore and controlled in such a manner so as to cause structural failure of the frac plug 200.

In one embodiment, the torch 257 may comprise the "Radial Cutting Torch", developed and sold by MCR Oil Tools Corporation. The Radial Cutting Torch includes a fuel load 251 constructed of thermite and classified as a flammable, nonexplosive solid. Using a nonexplosive material like thermite provides several advantages. Numerous federal regulations regarding the safety, handling and transportation of explosives add complexity when conveying explosives to an operational job site. In contrast, thermite is nonexplosive and thus does not fall under these federal constraints. Torches 257 constructed of thermite, including the Radial Cutting Torch, may be transported easily, even by commercial aircraft.

In order to ignite the fuel load 251, a firing mechanism 253 is employed that may be activated in a variety of ways. In one embodiment, a timer, such as an electronic timer, a mechanical timer, or a spring-wound timer, a volume timer, or a measured flow timer, for example, may be used to activate a heating source within the firing mechanism 253. In one embodiment, an electronic timer may activate a heating source when pre-defined conditions, such as time, pressure and/or temperature are met. In another embodiment, the electronic timer may activate the heat source purely as a function of time, such as after several hours or days. In still another embodiment, the electronic timer may activate when predefined temperature and pressure conditions are met, and after a specified time period has elapsed. In an alternate embodiment, the firing mechanism 253 may not employ time at all. Instead, a pressure actuated firing head that is actuated by differential pressure or by a pressure pulse may be used. It is contemplated that other types of devices may also be used. Regardless of the means for activating the firing mechanism 253, once activated, the firing mechanism 253 generates enough heat to ignite the fuel load 251 of the torch 257. In one embodiment, the firing mechanism 253 comprises the "Thermal Generator", developed and sold by MCR Oil Tools Corporation, which utilizes an electronic timer. When the electronic timer senses that pre-defined conditions have been met, such as a specified time has elapsed since setting the timer, a single AA battery activates a heating filament capable of generating enough heat to ignite the fuel load 251, causing it to burn. To accelerate consumption of the frac plug 200, a liquid or powder-based accelerant may be provided inside the annulus 254. In various embodiments, the accelerant may be liquid manganese acetate, nitromethane, or a combination thereof.

Figure 3:
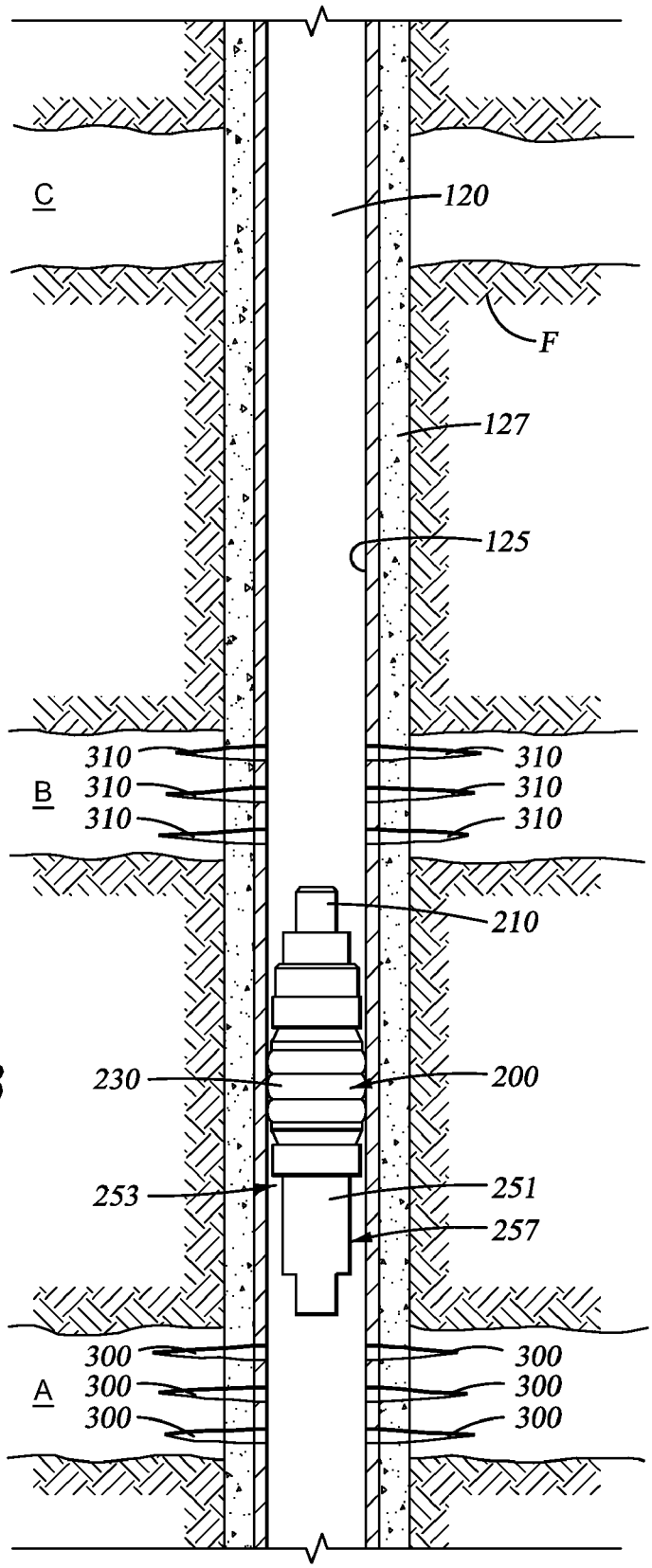
FIG. 3 is an enlarged cross-sectional side view of a well bore with a representative consumable downhole tool with an internal firing mechanism sealed therein.

In operation, the frac plug 200 of FIG. 2 may be used in a well stimulation/fracturing operation to isolate the zone of the formation F below the plug 200. Referring now to FIG. 3, the frac plug 200 of FIG. 2 is shown disposed between producing zone A and producing zone B in the formation F. As depicted, the frac plug 200 comprises a torch 257 with a fuel load 251 and a firing mechanism 253, and at least one consumable material component such as the tubular body member 210. The slips 240 and the mechanical slip bodies 245 may also be made of consumable material, such as magnesium metal. In a conventional well stimulation/fracturing operation, before setting the frac plug 200 to isolate zone A from zone B, a plurality of perforations 300 are made by a perforating tool (not shown) through the casing 125 and cement 127 to extend into producing zone A. Then a well stimulation fluid is introduced into the well bore 120, such as by lowering a tool (not shown) into the well bore 120 for discharging the fluid at a relatively high pressure or by pumping the fluid directly from the surface 105 into the well bore 120. The well stimulation fluid passes through the perforations 300 into producing zone A of the formation F for stimulating the recovery of fluids in the form of oil and gas containing hydrocarbons. These production fluids pass from zone A, through the perforations 300, and up the well bore 120 for recovery at the surface 105.

Prior to running the frac plug 200 downhole, the firing mechanism 253 is set to activate a heating filament when predefined conditions are met. In various embodiments, such predefined conditions may include a predetermined period of time elapsing, a specific temperature, a specific pressure, or any combination thereof. The amount of time set may depend on the length of time required to perform the well stimulation/fracturing operation. For example, if the operation is estimated to be performed in 12 hours, then a timer may be set to activate the heating filament after 12 hours have elapsed. Once the firing mechanism 253 is set, the frac plug 200 is then lowered by the work string 118 to the desired depth within the well bore 120, and the packer element assembly 230 is set against the casing 125 in a conventional manner, thereby isolating zone A as depicted in FIG. 3. Due to the design of the frac plug 200, the ball 225 will unseal the flowbore 205, such as by unseating from the surface 207 of the flowbore 205, for example, to allow fluid from isolated zone A to flow upwardly through the frac plug 200. However, the ball 225 will seal off the flowbore 205, such as by seating against the surface 207 of the flowbore 205, for example, to prevent flow downwardly into the isolated zone A. Accordingly, the production fluids from zone A continue to pass through the perforations 300, into the well bore 120, and upwardly through the flowbore 205 of the frac plug 200, before flowing into the well bore 120 above the frac plug 200 for recovery at the surface 105.

After the frac plug 200 is set into position as shown in FIG. 3, a second set of perforations 310 may then be formed through the casing 125 and cement 127 adjacent intermediate producing zone B of the formation F. Zone B is then treated with well stimulation fluid, causing the recovered fluids from zone B to pass through the perforations 310 into the well bore 120. In this area of the well bore 120 above the frac plug 200, the recovered fluids from zone B will mix with the recovered fluids from zone A before flowing upwardly within the well bore 120 for recovery at the surface 105.

If additional well stimulation/fracturing operations will be performed, such as recovering hydrocarbons from zone C, additional frac plugs 200 may be installed within the well bore 120 to isolate each zone of the formation F. Each frac plug 200 allows fluid to flow upwardly therethrough from the lowermost zone A to the uppermost zone C of the formation F, but pressurized fluid cannot flow downwardly through the frac plug 200.

After the fluid recovery operations are complete, the frac plug 200 must be removed from the well bore 120. In this context, as stated above, at least some of the components of the frac plug 200 are consumable when exposed to heat and an oxygen source, thereby eliminating the need to mill or drill the frac plug 200 from the well bore 120. Thus, by exposing the frac plug 200 to heat and an oxygen source, at least some of its components will be consumed, causing the frac plug 200 to release from the casing 125, and the unconsumed components of the plug 200 to fall to the bottom of the well bore 120.

In order to expose the consumable components of the frac plug 200 to heat and an oxygen source, the fuel load 351 of the torch 257 may be ignited to burn. Ignition of the fuel load 251 occurs when the firing mechanism 253 powers the heating filament. The heating filament, in turn, produces enough heat to ignite the fuel load 251. Once ignited, the fuel load 251 burns, producing high-pressure molten plasma that is emitted from the nozzles 255 and directed at the inner surface 211 of the tubular body member 210. Through contact of the molten plasma with the inner surface 211, the tubular body member 210 is burned and/or consumed. In an embodiment, the body member 210 comprises magnesium metal that is converted to magnesium oxide through contact with the molten plasma. Any other consumable components, such as the slips 240 and the mechanical slip bodies 245, may be consumed in a similar fashion. Once the structural integrity of the frac plug 200 is compromised due to consumption of its load carrying components, the frac plug 200 falls away into the well bore 120, and in some embodiments, the frac plug 200 may further be pumped out of the well bore 120, if desired.

In the method described above, removal of the frac plug 200 was accomplished without surface intervention. However, surface intervention may occur should the frac plug 200 fail to disengage and, under its own weight, fall away into the well bore 120 after exposure to the molten plasma produced by the burning torch 257. In that event, another tool, such as work string 118, may be run downhole to push against the frac plug 200 until it disengages and falls away into the well bore 120. Alternatively, a load may be applied to the frac plug 200 by pumping fluid or by pumping another tool into the well bore 120, thereby dislodging the frac plug 200 and/or aiding the structural failure thereof.

Figure 4:
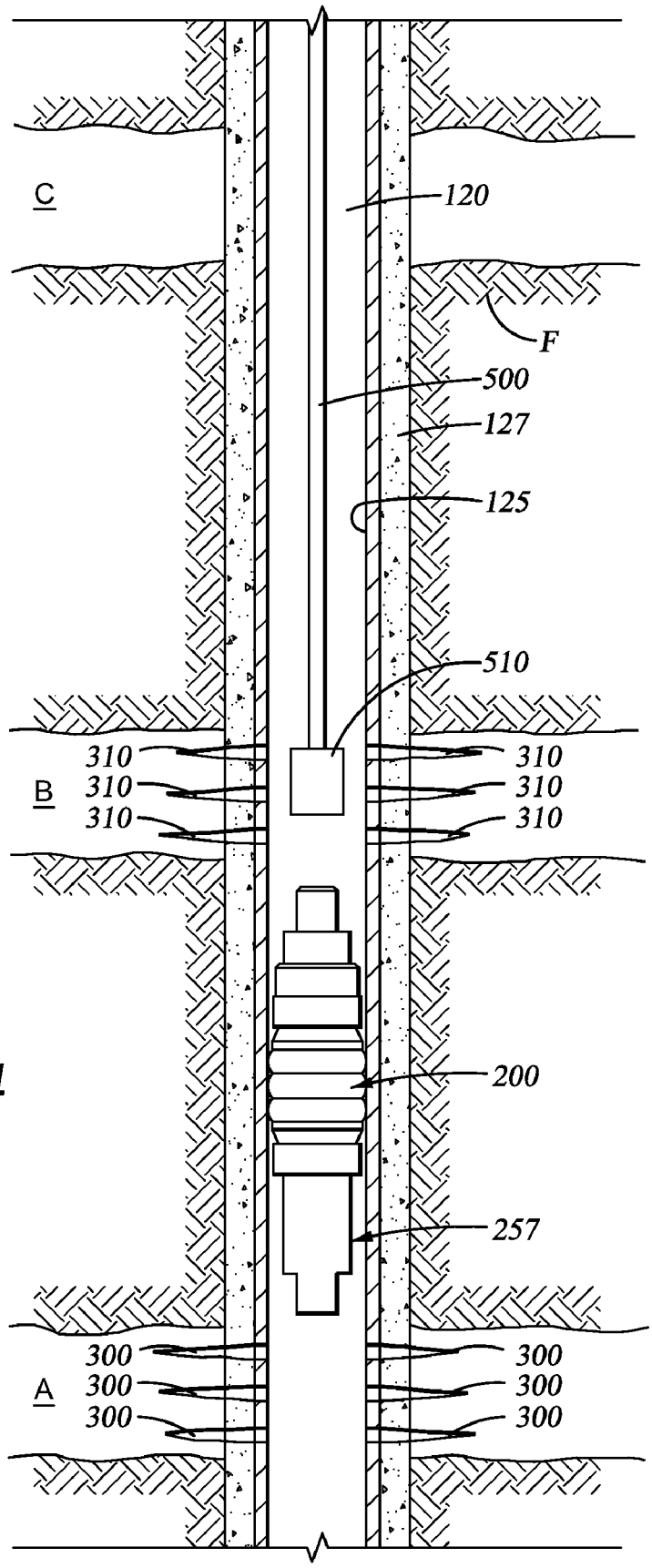
FIG. 4 is an enlarged cross-sectional side view of a well bore with a consumable downhole tool sealed therein, and with a line lowering an alternate firing mechanism towards the tool.

Surface intervention may also occur in the event that the firing mechanism 253 fails to activate the heat source. Referring now to FIG. 4, in that scenario, an alternate firing mechanism 510 may be tripped into the well bore 120. A slick line 500 or other type of work string may be employed to lower the alternate firing mechanism 510 near the frac plug 200. In an embodiment, using its own internal timer, this alternate firing mechanism 510 may activate to ignite the torch 257 contained within the frac plug 200. In another embodiment, the frac plug 200 may include a fuse running from the upper end of the tubular body member 210, for example, down to the fuel load 251, and the alternate firing mechanism 510 may ignite the fuse, which in turn ignites the torch 257.

In still other embodiments, the torch 257 may be unnecessary. As an alternative, a thermite load may be positioned on top of the frac plug 200 and ignited using a firing mechanism 253. Molten plasma produced by the burning thermite may then burn down through the frac plug 200 until the structural integrity of the plug 200 is compromised and the plug 200 falls away downhole.

Removing a consumable downhole tool 100, such as the frac plug 200 described above, from the well bore 120 is expected to be more cost effective and less time consuming than removing conventional downhole tools, which requires making one or more trips into the well bore 120 with a mill or drill to gradually grind or cut the tool away. The foregoing descriptions of specific embodiments of the consumable downhole tool 100, and the systems and methods for removing the consumable downhole tool 100 from the well bore 120 have been presented for purposes of illustration and description and are not intended to be exhaustive or to limit the invention to the precise forms disclosed. Obviously many other modifications and variations are possible. In particular, the type of consumable downhole tool 100, or the particular components that make up the downhole tool 100 could be varied. For example, instead of a frac plug 200, the consumable downhole tool 100 could comprise a bridge plug, which is designed to seal the well bore 120 and isolate the zones above and below the bridge plug, allowing no fluid communication in either direction. Alternatively, the consumable downhole tool 100 could comprise a packer that includes a shiftable valve such that the packer may perform like a bridge plug to isolate two formation zones, or the shiftable valve may be opened to enable fluid communication therethrough.

While various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What we claim our invention is:

1. A downhole tool comprising:

a tubular body comprising a cavity and a material that is at least partially consumed when exposed to heat and oxygen; and a plurality of slips disposed around the tubular body;

a sealing element disposed around the tubular body;

a torch coupled to the tubular body and comprising:

a fuel load that produces the heat when burned and comprises a source of oxygen; and a torch body with a plurality of nozzles distributed along the length of the torch body, wherein at least one of the nozzles is positioned within the cavity of the tubular body, and wherein the at least one nozzle is configured to distribute the heat and the oxygen to the tubular body to at least partially consume the tubular body.

2. The downhole tool of claim 1 wherein the material comprises a metal.

3. The downhole tool of claim 2 wherein the metal is magnesium.

4. The downhole tool of claim 3 wherein the magnesium metal is converted to magnesium oxide when exposed to the heat and oxygen.

5. The downhole tool of claim 1 wherein the fuel load comprises a flammable, non-explosive solid.

6. The downhole tool of claim 1 wherein the fuel load comprises thermite.

7. The downhole tool of claim 1 wherein the nozzles distribute molten plasma produced when the fuel load is burned.

8. The downhole tool of claim 1 wherein the torch further comprises a firing mechanism with a heat source to ignite the fuel load.

9. The downhole tool of claim 8 wherein the firing mechanism further comprises a device to activate the heat source.

10. The downhole tool of claim 9 wherein the device comprises an electronic timer, a mechanical timer, a spring-wound timer, a volume timer, or a measured flow timer.

11. The downhole tool of claim 10 wherein the timer is programmable to activate the heat source when pre-defined conditions are met.

12. The downhole tool of claim 11 wherein the pre-defined conditions comprise elapsed time, temperature, pressure, volume, or any combination thereof.

13. The downhole tool of claim 9 wherein the device comprises a pressure-actuated firing head.

14. The downhole tool of claim 8 wherein the firing mechanism is an electronic igniter.

15. The downhole tool of claim 1 further comprising an enclosure for storing an accelerant.

16. The downhole tool of claim 1 wherein the tool is a frac plug, a bridge plug, a packer, or a well bore zonal isolation device.

17. The downhole tool of claim 1 wherein the tubular body component comprises a check valve.

18. The downhole tool of claim 1 wherein the cavity is an axial flowbore.

19. The downhole tool of claim 1 wherein the nozzles have a higher melting temperature than the tubular body.

20. The downhole tool of claim 1 wherein the nozzles are angled to direct a flow exiting the nozzles towards an inner surface of the tubular body or structural component.

21. The downhole tool of claim 1 wherein two or more nozzles are positioned within the cavity.

22. The downhole tool of claim 1 wherein the fuel load is external to the cavity.

23. A downhole tool comprising:

a tubular body having an axial flowbore;

a sealing element and one or more slips disposed around the tubular body; and a torch having a plurality of nozzles distributed along the length of the torch body, wherein one or more of the nozzles are disposed within the axial flowbore, wherein at least a portion of the tubular body is consumed when exposed to heat and a source of oxygen produced by the torch.

24. The downhole tool of claim 23 wherein the torch comprises thermite that produces the heat and source of oxygen when ignited.

25. The downhole tool of claim 24 wherein the tubular body, the one or more slips, or both comprise magnesium that is converted to magnesium oxide when exposed to the heat and source of oxygen.

26. The downhole tool of claim 24 further comprising an electronic firing mechanism to ignite the thermite.

27. The downhole tool of claim 23 wherein an annular flow space exists between the torch and axial flowbore.

28. The downhole tool of claim 23 wherein the nozzles are angled to direct a flow exiting the nozzles towards an inner surface of the tubular body or structural component.

29. The downhole tool of claim 23 wherein two or more nozzles are disposed within the axial flowbore.

30. The downhole tool of claim 23 wherein the torch further comprises a fuel load external to the axial flowbore.

* * * * *